US012305470B2

(12) United States Patent
Davison

(10) Patent No.: US 12,305,470 B2
(45) Date of Patent: May 20, 2025

(54) PLUG WITH SHUTTLE VALVE

(71) Applicant: Epic Lift Systems, Houston, TX (US)

(72) Inventor: Douglas Wayne Davison, Canyon Lake, TX (US)

(73) Assignee: TALLY USA, LLC, Houston, TX (US)

( * ) Notice: Subject to any disclaimer, the term of this patent is extended or adjusted under 35 U.S.C. 154(b) by 0 days.

(21) Appl. No.: 18/327,186

(22) Filed: Jun. 1, 2023

(65) Prior Publication Data

US 2023/0392467 A1 Dec. 7, 2023

Related U.S. Application Data

(60) Provisional application No. 63/349,670, filed on Jun. 7, 2022.

(51) Int. Cl.
*E21B 33/12* (2006.01)
*E21B 34/06* (2006.01)

(52) U.S. Cl.
CPC ..... *E21B 33/12* (2013.01); *E21B 34/06* (2013.01)

(58) Field of Classification Search
CPC ..... E21B 34/06; E21B 34/14; E21B 34/142; E21B 33/12
See application file for complete search history.

(56) References Cited

U.S. PATENT DOCUMENTS 3,845,815 A * 11/1974 Garwood ..... E21B 34/14 166/194
5,701,959 A * 12/1997 Hushbeck ..... E21B 33/1216 166/387
2008/0190600 A1* 8/2008 Shkurti ..... E21B 33/134 166/134
2011/0308820 A1* 12/2011 Greenlee ..... E21B 33/1295 166/387
2021/0148179 A1* 5/2021 Petrella ..... E21B 33/1277
2021/0404300 A1* 12/2021 Fitzhugh ..... E21B 33/1292

* cited by examiner

*Primary Examiner* — Tara Schimpf
*Assistant Examiner* — Lamia Quaim
(74) *Attorney, Agent, or Firm* — Park, Vaughan, Fleming & Dowler LLP

(57) ABSTRACT

An improved plug with shuttle valve is disclosed. The improved plug has a bore in which a shuttle valve travels between stops in the bore. The traveling shuttle valve serves to reduce wellbore pressure across at least portions of the plug, thereby at least reducing the possibility of damage resulting from undue wellbore pressure and leak spots.

35 Claims, 4 Drawing Sheets

PLUG WITH SHUTTLE VALVE

PRIORITY CLAIM

This application claims priority to provisional patent application Ser. No. 63/349,670 filed Jun. 7, 2022, which is fully incorporated herein by reference.

TECHNICAL FIELD OF THE INVENTION

Embodiments of the subject matter disclosed herein relate to plugs used in hydrocarbon recovery operations. More specifically, aspects of the disclosure relate to an improved plug with shuttle valve, and methods of operating and using the same.

DISCUSSION OF THE BACKGROUND

Hydrocarbon recovery operations may take many forms. Over time, these operations have evolved to allow for economical recovery of hydrocarbons from available resources. To achieve this economical recovery, many different types of tools may be employed by field personnel to conduct efficient operations. These operations may include recovery of natural gas, oil and/or mixtures of natural gas and oil.

Past conventional recovery operations were simple from a technical perspective. A drill rig was placed over a hydrocarbon-bearing reservoir. The drill rig was activated and a drill string was created to drill down to the reservoir. Once penetrated, the reservoir was extracted through either its own inherent pressure or through pumping the reservoir contents up through the drill string.

As time has progressed, conventional reservoirs that have been discovered have been much smaller or more difficult to produce compared to earlier times. As the need for oil and gas has increased over time, new technologies are required to meet industry needs for extracting the contents of these reserves.

One new source for hydrocarbons is found in shale fields. Shale fields contain hydrocarbons that may be recovered using a variety of technologies. One of these technologies involves the process of hydraulic fracturing. To liberate hydrocarbons trapped within shale, sections of a wellbore are sealed from other sections of the wellbore (sometimes referred to as "zone isolation") and a hydraulic fracturing fluid is pumped down to the sealed wellbore sections. Pressure is increased in the sealed (or isolated) wellbore sections until the hydraulic pressure breaks the wellbore casing and/or geological formation around those wellbore sections.

The broken geological formations are maintained in an open "cracked" configuration by pumping down sand or other granular type materials that lodge within the cracks, thereby preventing closure of the cracks. Hydrocarbons trapped in the geological formation are released due to the decreased pressure in the formations. The hydrocarbons are collected in the wellbore and pumped or flowed to an up-hole environment.

To section off portions of the wellbore in order to accomplish the hydraulic fracturing and other well operations, plugs are used to wedge into predefined sections of the wellbore. These plugs often are referred to as "toe" plugs, "cap" plugs, and/or frac plugs. Those skilled in the art will appreciate that the naming conventions can and do vary. While plugs have been used for many years, there are many drawbacks in such conventional designs.

Conventional plugs are expensive to produce. Multiple sections including wedges, rings, and bearing surfaces must be finely machined to allow the plug to wedge within the wellbore. Often these multiple sections must be individually made and then assembled into a single unit.

Likewise, materials used to manufacture plugs have changed over time due to technological, as well as economic, issues. For example, in order to ease the process of drilling a plug out of a wellbore after use, manufacturers have started to build plugs from non-metallic materials since they are easier to drill than their metallic counterparts. Using non-metallic materials, however, presents problems of its own since such materials are more susceptible to failure due to downhole pressure. Leak spots also are an issue in conventional plugs. Consequently, it has become necessary to adapt plug designs in an effort to counter these known problems with prior art plugs. The present invention is one such adaptation.

SUMMARY

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is later discussed.

Described herein are embodiments of an improved plug with shuttle valve, and methods of operating and using the same. Some of those embodiments are reflected in the following drawings, modifications of which will be appreciated by those skilled in the art to be within the scope of the disclosed invention. In general, the invention concerns a plug having a bore in which a shuttle valve travels between stops in the bore. The traveling shuttle valve serves to reduce pressure across at least portions of the plug, thereby at least reducing the possibility of damage resulting from undue pressure and leak spots. The scope of the invention is better captured and articulated in the attached claims.

BRIEF DESCRIPTION OF THE DRAWINGS

The disclosure may be understood by reference to the following description taken in conjunction with the accompanying drawings, in which like reference numerals identify like elements, and in which.

DETAILED DESCRIPTION

Various features and advantageous details are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended or implied. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 1:
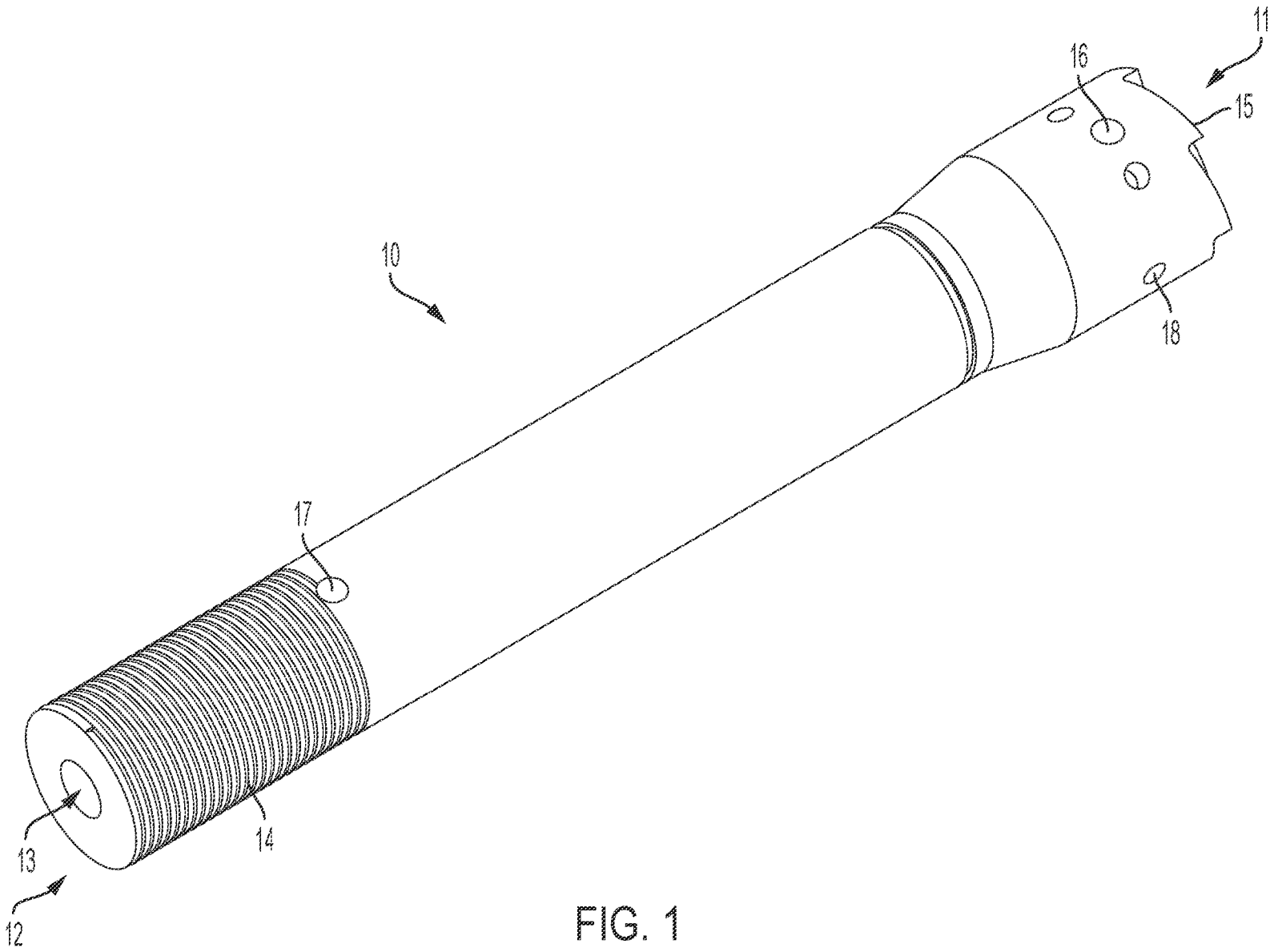
FIG. 1 is a perspective view of one embodiment of a plug mandrel.
Figure 3:
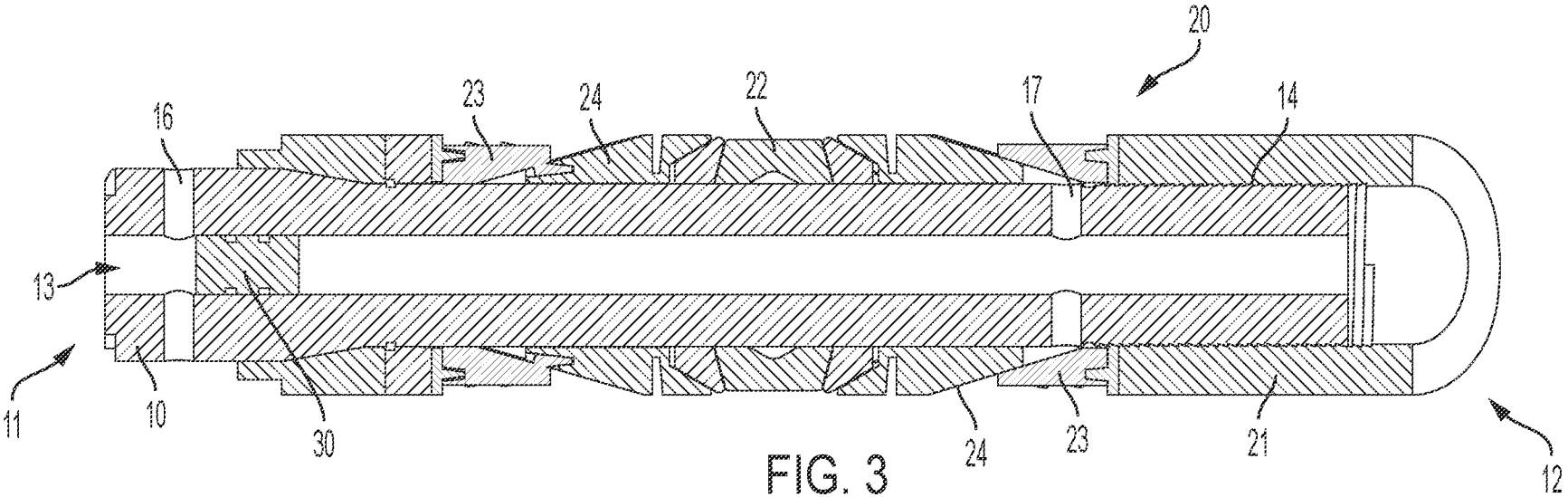
FIG. 3 is a cross section of FIG. 2 taken along cross section line 3-3.

The present embodiments describe an improved plug with shuttle valve, and methods of operating and using the same. Those skilled in the art will appreciate the purpose, function, and operation of a plug and its components for use in zone isolation. For example, FIG. 1 is a perspective view of one embodiment of a plug mandrel 10. As show and as also shown in FIG. 3, mandrel 10 may include a first upper end generally at 11 and a second, opposite lower end generally at 12. In this exemplary mandrel, a bore 13 may extend between first end 11 and second end 12. Those skilled in the art will appreciate that upper end 11 and lower end 12 need not be at the terminal ends of mandrel 10 and/or the plug itself, but rather can be at points between the terminal ends.

Exemplary mandrel 10 may also include at least one threaded portion 14, this one at second end 12. Mandrel 10 also may include one or more clutch ends 15, which can assist in drilling successively installed plugs, as described in more detail in U.S. Pat. No. 11,613,740, the contents of which are hereby incorporated by reference. Mandrel 10 may also include one or more pin holes 16 and 17, which as described in more detail below can be used as pin or stop inserts that are used to control the travel of a shuttle valve in the mandrel's bore 13. Finally, mandrel 10 may also include one or more shear pin inserts 18, which are used to receive one or more shear pins, respectively, for use when installing the plug in a wellbore.

Figure 2:
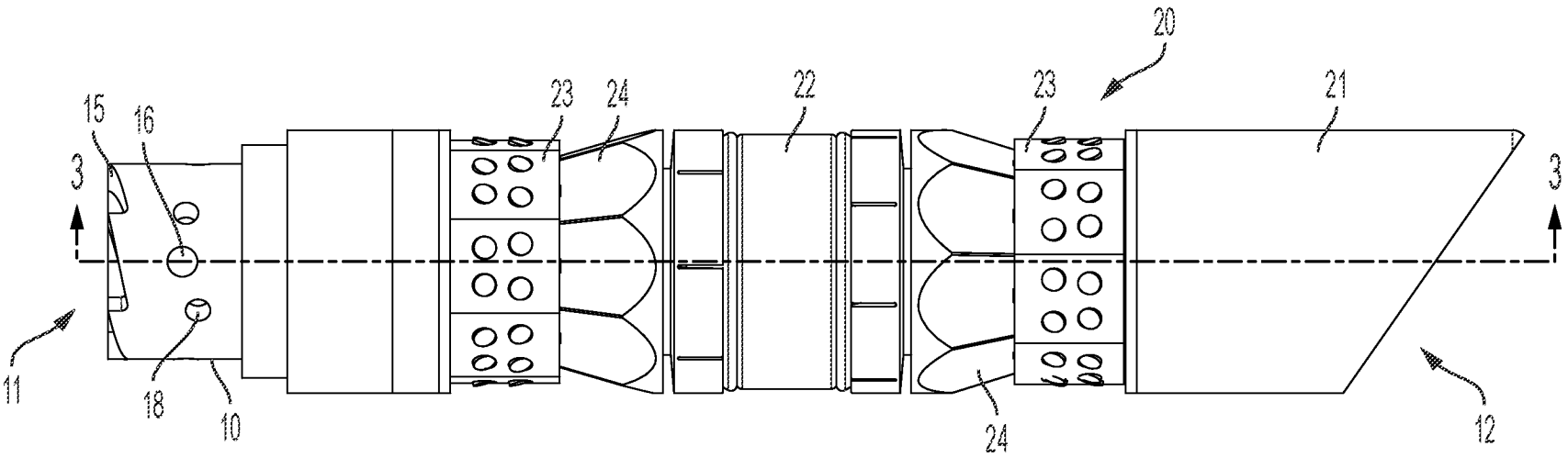
FIG. 2 is a side view of one embodiment of a plug, including cross section line 3-3.
Figure 4:
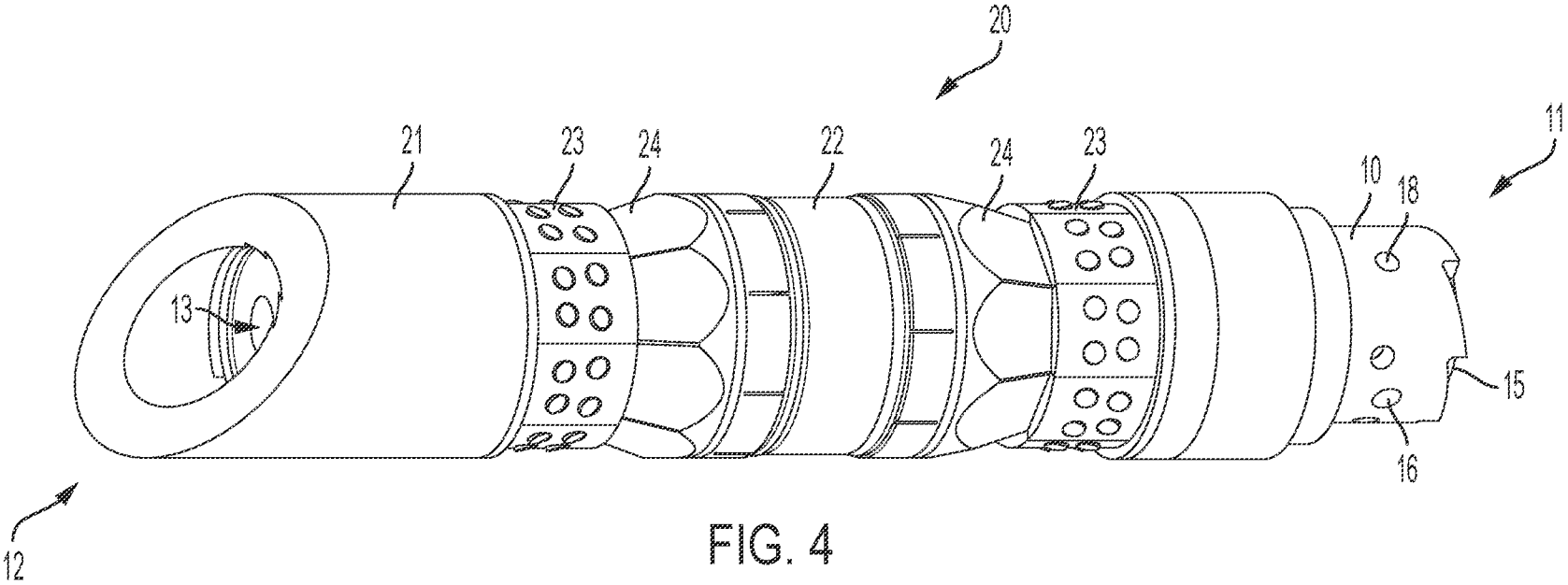
FIG. 4 is a perspective view of the plug shown in FIG. 2.

FIG. 2 is a side view of one embodiment of a plug 20, including cross section line 3-3, which includes the present invention. FIG. 3 is a cross section of FIG. 2 taken along cross section line 3-3. FIG. 4 is a perspective view of the embodiment of FIG. 2. As FIGS. 2-4 show, exemplary plug 20 may include a number of separate components that may generally be built around mandrel 10. As those skilled in the art will appreciate, a plug must have some mechanism for maintaining it in a wellbore. In this example, the plug is shown as including a slip and wedge system made up of upper and lower slips 23 and wedges 24, which will be familiar to those skilled in the art and which is described in more detail in U.S. Pat. No. 11,613,740. Likewise, plug 20 may have sealing element 22, which isolates the wellbore above the plug from the wellbore below the plug when the plug is installed in the wellbore. As those skilled in the art will appreciate, such plugs can be used as a bridge plug (including a cap plug and/or a toe plug) as well as a frac plug.

FIG. 3 better illustrates an exemplary structure and function of shuttle valve 30 deployed in bore 13 of mandrel 10 of plug 20. Specifically, in this particular embodiment, of which there are others within the scope of the present invention, shuttle valve 30 is sized and deployed in bore 13 to move between an upper stop and a lower stop, where the upper stop in this embodiment is a pin inserted through holes 16 on either side of the plug, and the lower stop is a pin inserted through holes 17 on either side of the plug. As indicated, the purpose of each pin is to stop shuttle valve 30 from moving through the bore past the pin/stop in the bore. Other stopping mechanisms (other than a pin) are within the scope of the present invention. For example, pinhole 16/17 may not traverse both sides of the plug and something other than a pin could be used as a stop. As long as a mechanism is in place to stop the shuttle valve from traveling through the bore beyond the stop, that is all that is required of the "stop" for embodiments of the present invention.

Operation of the present invention is perhaps best described in connection with FIG. 3. For example, when plug 20 is being used as a cap plug, i.e., mounted in an upper section of the wellbore, pressure (hydrostatic) from the reservoir will enter bore 13 from the plug's second end 12, thereby driving shuttle valve 30 up the bore until it is precluded by the upper stop from traveling any further. Since the upper stop is located in the upper portion of the plug, pressure will equalize on the inside (inside diameter) and outside (outside diameter) of the plug below the stop, thereby producing at least several benefits. First, the equalized external/internal pressure prevents an otherwise unequalized pressure from crushing or otherwise damaging the plug, especially plugs made from non-metallic materials (e.g., an epoxy glass laminate) that are more easily drilled but also are more susceptible to pressure damage. Second, the equalized pressure remedies potential leak spots/paths in the plug. Those skilled in the art will appreciate that plugs suffer from potential leakage attributable at least in part to the differential in pressure between the inside and outside of the plug. By equalizing the external and internal pressure, there is no pressure differential sufficient to cause a leak spot in the regions of equalized pressure. In that regard, note also that the positioning of the upper stop above sealing element 22 (a traditional leak spot) ensures that leakage around the plug's sealing element is substantially eliminated. Accordingly, when being used as a cap plug, the upper stop can be located in the bore at any point below which the designer desires to equalize pressure and, as such, may vary depending on at least user preference and well conditions. Finally, when the plug is being drilled out, the plug's hollow bore 13 acts as a vent by equalizing wellbore pressure across the plug when the drilling process passes shuttle valve 30, thereby preventing the dangerous scenario of the well uncontrollably ejecting the remnants of the plug and potentially the drilling string itself when the drilling process reaches the mechanism anchoring the plug in the wellbore.

When the plug is being used as a toe plug, i.e., mounted in a lower section of the wellbore, pressure from the reservoir being produced will enter bore 13 from the first end 11 of the plug, thereby driving shuttle valve 30 down the bore until it is precluded by the lower stop from traveling any further. Since the lower stop is located in the lower portion of the plug, pressure (typically induced from the surface) will equalize on the inside and outside of the plug above the lower stop, thereby reproducing similar benefits described above. Note in this case that sealing element 22 being a potential leak spot is once again substantially eliminated by the lower stop being positioned below sealing element 22. Accordingly, when being used as a toe plug, the lower stop can be located in the bore at any point above which the designer desires to equalize pressure and, as such, may vary depending on at least user preference and well conditions.

Figure 5:
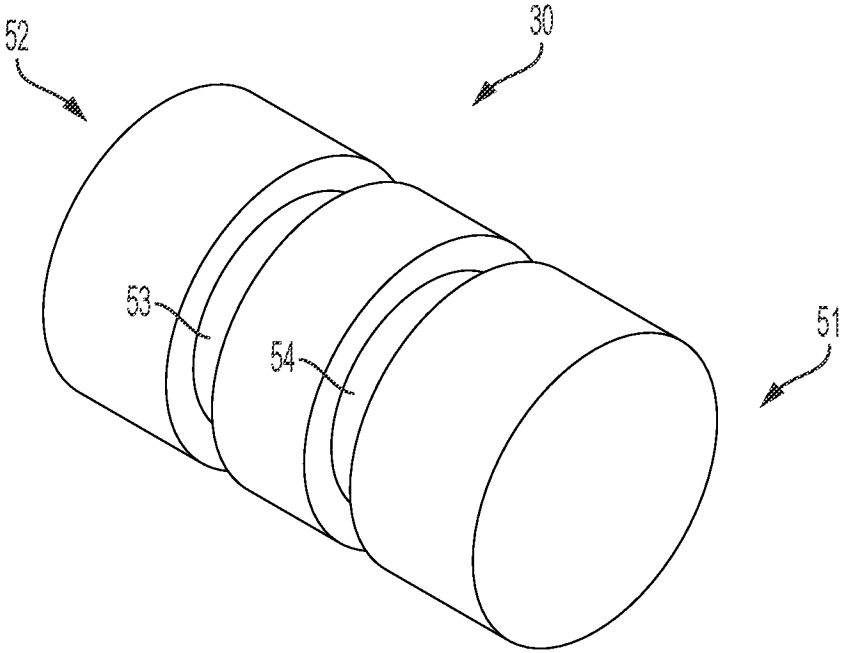
FIG. 5 is a perspective view of one embodiment of a shuttle valve shown in FIG. 3.

FIG. 5 is a perspective view of an embodiment of shuttle valve 30 shown in FIG. 3. The exemplary shuttle valve 30 may have a first end 51 and a second end 52, between which are two separate grooves 53 and 54 around the entire circumference of the valve. These grooves each are intended to retain an elastomeric seal (not shown) such that when shuttle valve 30 is installed in bore 13 the valve/seal combination serves to substantially seal the bore of gas or fluid communicating across the seals. While the exemplary embodiment illustrates two such grooves/seals, those skilled in the art will appreciate that more or less seals/grooves can be utilized, as well as other options for sealing valve 30 in bore 13. Because seals are use in this particular embodiment, shuttle valve 30 has a diameter slightly less than the diameter of bore 13.

Figure 6:
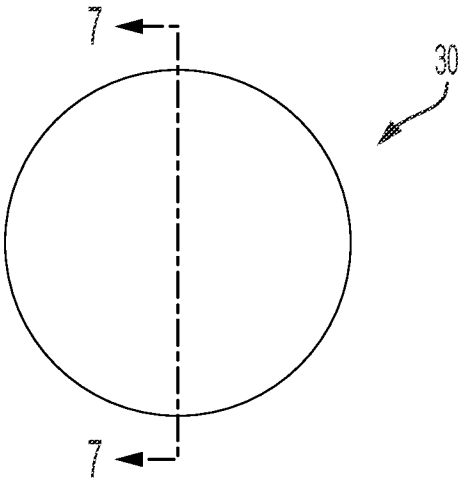
FIG. 6 is a top view of the shuttle valve shown in FIG. 5, including cross section line 7-7.
Figure 7:
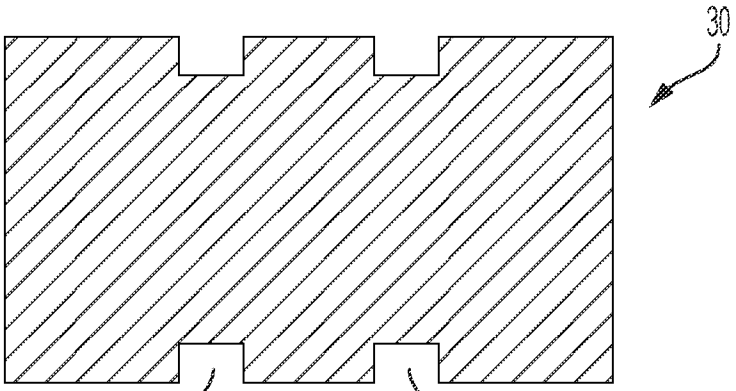
FIG. 7 is a cross section of FIG. 6 taken along cross section line 7-7.

FIG. 6 is a top view of the shuttle valve shown in FIG. 5, including cross section line 7-7. FIG. 7 is a cross section of FIG. 6 taken along cross section line 7-7. As indicated, however, the present invention is not limited to the geometry or sealing mechanism showing the FIGS. 3 and 5-7. Other geometries and sealing mechanisms are possible so long as they are capable of traveling in the plug's bore between an upper and lower stop and at least substantially sealing the bore against gas or liquid traversing the seal. In a preferred embodiment, the shuttle valve will travel between the first and second stop in response to approximately 300-400 pounds of pressure, although those skilled in the art will appreciate that the shuttle valve can be constructed to travel in response to other pressures. Likewise in a preferred embodiment, shuttle valve 30 is constructed from a glass filled peek material for its drillable and mechanical properties, preferably 30% glass filled peek material. Other materials are possible, such as aluminum, phenolic and other materials known to those skilled in the art.

In another preferred embodiment, during manufacture of the plug the shuttle valve is installed in the plug's/mandrel's bore before pin holes 16/17 are drilled into the body of the mandrel since the pin holes have a tendency to damage the seals on the shuttle valve if the shuttle valve is installed in the bore after the pin holes have been drilled.

Although the invention(s) is/are described herein with reference to specific embodiments, various modifications and changes can be made without departing from the scope of the present invention(s), as set forth in the claims below. Accordingly, the specification and Figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

Accordingly, the protection sought herein is as set forth in the claims below.

The invention claimed is:

1. A wellbore plug for use in the bore of an oil and gas well, where the wellbore plug comprises:

a bore;

a first stop in the bore of the wellbore plug;

a second stop in the bore of the wellbore plug;

a sealing element surrounding the bore of the wellbore plug and positioned entirely between the first stop and the second stop such that there is no overlap between the sealing element and the first stop and the second stop, whereby the sealing element prevents contents in the bore of the oil and gas well from traveling between the sealing element and a wall of the bore of the oil and gas well when the wellbore plug is mounted in the bore of the oil and gas well; and a shuttle valve mounted in the bore of the wellbore plug to travel between the first stop and the second stop, whereby the shuttle valve is stopped by the first stop when pressure in the bore of the wellbore plug below the shuttle valve is greater than pressure in the bore of the wellbore plug above the shuttle valve, and whereby the shuttle valve is stopped by the second stop when pressure in the bore of the wellbore plug above the shuttle valve is greater than pressure in the bore of the wellbore plug below the shuttle valve.

2. The wellbore plug of claim 1 wherein the first stop is mounted in the bore of the wellbore plug above the second stop.

3. The wellbore plug of claim 2 wherein the first stop is mounted in an upper end of the plug.

4. The wellbore plug of claim 3 wherein the second stop is mounted in a lower end of the plug.

5. The wellbore plug of claim 4 wherein, when the plug is mounted in the bore of an oil and gas well, the bore of the wellbore plug has a first end open to the wellbore and a second end open to the wellbore.

6. The wellbore plug of claim 5 wherein, when the plug is mounted in the bore of the oil and gas well, pressure in the bore of the plug below the shuttle valve is equal to pressure in the bore of the oil and gas well below the plug when the shuttle valve is stopped by the first stop.

7. The wellbore plug of claim 6 wherein, when the plug is mounted in the bore of the oil and gas well, pressure in the bore of the plug above the shuttle valve is equal to pressure in the bore of the oil and gas well above the plug when the shuttle valve is stopped by the second stop.

8. The wellbore plug of claim 7 wherein the first end of the bore of the plug is at an upper, terminal end of the plug.

9. The wellbore plug of claim 8 wherein the second end of the bore of the plug is at a lower, terminal end of the plug.

10. The wellbore plug of claim 9 wherein the first stop is a pin that traverses at least part of the bore of the plug.

11. The wellbore plug of claim 10 wherein the second stop is a pin that traverses at least part of the bore of the plug.

12. The wellbore plug of claim 11 further comprising a slip and wedge system for maintaining the wellbore plug in the bore of the oil and gas well.

13. The wellbore plug of claim 12 wherein the slip and wedge system includes a plurality of upper slips and wedges and a plurality of lower slips and wedges.

14. The wellbore plug of claim 13 wherein the sealing element is positioned on the wellbore plug between the upper slips and wedges and the lower slips and wedges.

15. The wellbore plug of claim 14 constructed of non-metallic components.

16. The wellbore plug of claim 15 wherein the plug is a toe plug.

17. The wellbore plug of claim 15 wherein the plug is a cap plug.

18. The wellbore plug of claim 15 wherein the plug is a frac plug.

19. A wellbore plug for use in the bore of an oil and gas well, where the wellbore plug comprises:

a bore having a first end open to the wellbore and a second end open to the wellbore;

a first stop in the bore of the wellbore plug;

a second stop in the bore of the wellbore plug;

a sealing element surrounding the bore of the wellbore plug and positioned between the first stop and the second stop, whereby the sealing element prevents contents in the bore of the oil and gas well from traveling between the sealing element and a wall of the bore of the oil and gas well when the wellbore plug is mounted in the bore of the oil and gas well; and a shuttle valve mounted in the bore of the wellbore plug to travel between the first stop and the second stop, whereby the shuttle valve is stopped by the first stop when pressure in the bore of the wellbore plug below the shuttle valve is greater than pressure in the bore of the wellbore plug above the shuttle valve, and whereby the shuttle valve is stopped by the second stop when pressure in the bore of the wellbore plug above the shuttle valve is greater than pressure in the bore of the wellbore plug below the shuttle valve.

20. The wellbore plug of claim 19 wherein the first stop is mounted in the bore of the wellbore plug above the second stop.

21. The wellbore plug of claim 20 wherein the first stop is mounted in an upper end of the plug.

22. The wellbore plug of claim 21 wherein the second stop is mounted in a lower end of the plug.

23. The wellbore plug of claim 22 wherein, when the plug is mounted in the bore of the oil and gas well, pressure in the bore of the plug below the shuttle valve is equal to pressure in the bore of the oil and gas well below the plug when the shuttle valve is stopped by the first stop.

24. The wellbore plug of claim 23 wherein, when the plug is mounted in the bore of the oil and gas well, pressure in the bore of the plug above the shuttle valve is equal to pressure in the bore of the oil and gas well above the plug when the shuttle valve is stopped by the second stop.

25. The wellbore plug of claim 24 wherein the first end of the bore of the plug is at an upper, terminal end of the plug.

26. The wellbore plug of claim 25 wherein the second end of the bore of the plug is at a lower, terminal end of the plug.

27. The wellbore plug of claim 26 wherein the first stop is a pin that traverses at least part of the bore of the plug.

28. The wellbore plug of claim 27 wherein the second stop is a pin that traverses at least part of the bore of the plug.

29. The wellbore plug of claim 28 further comprising a slip and wedge system for maintaining the wellbore plug in the bore of the oil and gas well.

30. The wellbore plug of claim 29 wherein the slip and wedge system includes a plurality of upper slips and wedges and a plurality of lower slips and wedges.

31. The wellbore plug of claim 30 wherein the sealing element is positioned on the wellbore plug between the upper slips and wedges and the lower slips and wedges.

32. The wellbore plug of claim 31 constructed of non-metallic components.

33. The wellbore plug of claim 32 wherein the plug is a toe plug.

34. The wellbore plug of claim 32 wherein the plug is a cap plug.

35. The wellbore plug of claim 32 wherein the plug is a frac plug.

* * * * *